US012123198B1

(12) United States Patent
Shin

(10) Patent No.: US 12,123,198 B1
(45) Date of Patent: Oct. 22, 2024

(54) EARTHQUAKE-RESISTANT BUILDING INTERIOR AND EXTERIOR MATERIAL UNIT SYSTEM

(71) Applicant: ChangYoon Shin, Gwangju (KR)

(72) Inventor: ChangYoon Shin, Gwangju (KR)

(73) Assignee: JS Global Enterprise, Inc, Gwangju (KR)

( * ) Notice: Subject to any disclaimer, the term of this patent is extended or adjusted under 35 U.S.C. 154(b) by 180 days.

(21) Appl. No.: 17/803,553

(22) Filed: Aug. 25, 2022

(51) Int. Cl.
*E04F 13/08* (2006.01)

(52) U.S. Cl.
CPC ..... *E04F 13/0805* (2013.01)

(58) Field of Classification Search
None
See application file for complete search history.

(56) References Cited

U.S. PATENT DOCUMENTS

2010/0325997 A1* 12/2010 Scully ..... E04F 13/0805 52/489.1
2018/0283012 A1* 10/2018 Hohmann, Jr. ..... E04F 13/081

FOREIGN PATENT DOCUMENTS

KR 20200035542 A * 4/2020

OTHER PUBLICATIONS

Prior Art Translation.*

* cited by examiner

*Primary Examiner* — Joshua K Ihezie
(74) *Attorney, Agent, or Firm* — LEX IP MEISTER, PLLC

(57) ABSTRACT

An earthquake-resistant building interior/exterior unit system with thermal insulation is disclosed, which responds flexibly to external shocks or earthquakes, and which is excellent in workability and constructability to shorten the installation time while reducing the workforce at the construction site where the invention includes a pair of vertical frames that are spaced apart from each other and arranged symmetrically in which guide grooves are formed in the longitudinal direction where to the Multiple exterior materials are then attached to and installed on the outer side of the frame and a plurality of clips are attached to and installed on the side portion the frame, and further, a bracket is fixedly installed with a fastening bolt on a side portion of a frame on one side of the exterior material unit and an anchor bolt is used in which the bracket is fixedly installed on the wall of the building.

7 Claims, 20 Drawing Sheets

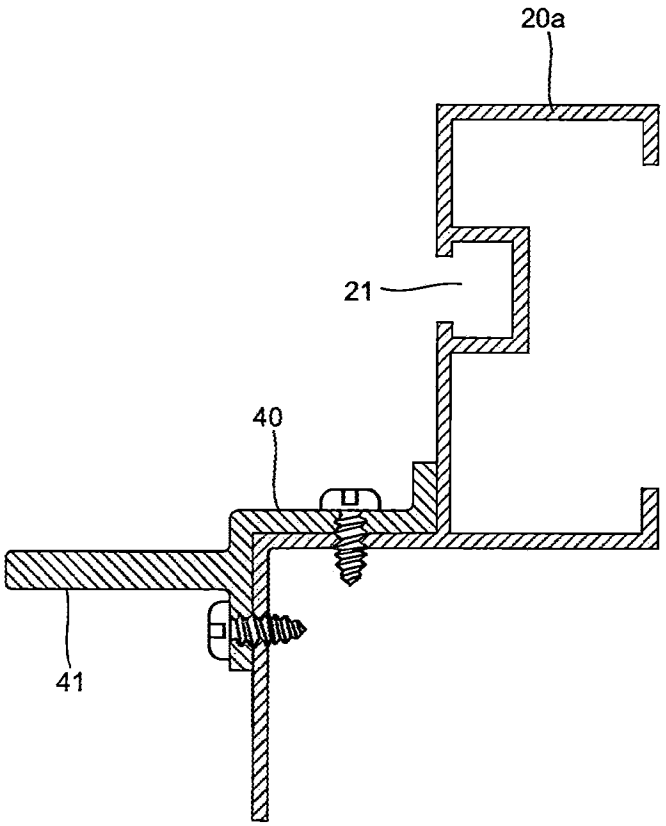
FIG. 9
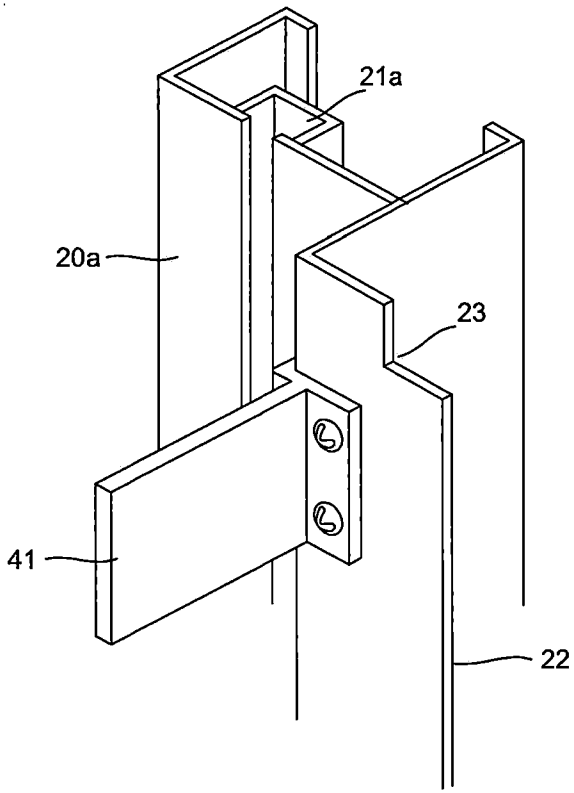

EARTHQUAKE-RESISTANT BUILDING INTERIOR AND EXTERIOR MATERIAL UNIT SYSTEM

CROSS-REFERENCE TO RELATED APPLICATION(S)

This application claims the benefit under 35 U.S.C. § 119 (a) of a Korean patent application filed on Nov. 15, 2021 in the Korean Intellectual Property Office and assigned Ser. No. 1020210156583A, the entire disclosure of which is hereby incorporated by reference.

FIELD OF THE INVENTION

The present invention relates to a building exterior material that is attached to an exterior or interior wall in a building. More particularly, the present invention relates to an earthquake-resistant building interior and exterior material unit system with thermal insulation that can respond more flexibly to external shocks or earthquakes due to the characteristics of the unit system.

BACKGROUND OF THE INVENTION

Generally, wet and dry methods are applied to the finishing method of attaching exterior materials to an exterior or interior wall in a building such as a building or an office, where the wet method uses cement mortar as an adhesive material for the construction of the building. However, the curing time of the mortar in the wet method of attaching an exterior material to a wall for construction is long and this method is also uneconomical due to problems in construction.

In addition, dry wall fixing method has also used a method for attaching and constructing an exterior material by installing a separate fixing device made of a structure on the wall of a building. Prior art document number KR101836445 titled "wall finishing assembly with spacing control function" discloses the dry construction method for attaching and constructing a finishing panel to the wall of an existing building. The prior art has the advantage that the mutual smoothness of the finishing panels can be increased by making it possible to finely adjust the spacing of the finishing panels with respect to the wall surface, and the finishing panels installed adjacent to each other are closely located, so that the waterproofing and soundproofing efficiency is excellent.

However, as the frequency of earthquakes is increasing in recent years, existing buildings and facilities do not take into account earthquakes insufficiently and have weak seismic performance, so unexpected earthquakes may occur. As a result, enormous damage can be caused due to breakage or collapse of the assembly of the cited prior art in an event of an earthquake.

Another prior art document KR101602460 titled "seismic panel for vibration absorption" provides a seismic panel for reducing damage by simultaneously absorbing horizontal and vertical vibrations generated in a building due to an existing earthquake. This prior art can absorb horizontal and vertical vibrations occurring in a building due to an earthquake at the same time by installing and using a moving member inserted into the guide rail in the vertical and horizontal directions of the vibration-absorbing panel for vibration absorption.

Further, the moving member is also inserted in the side frame by using the corner frame to support the fixed member, to prevent twisting or twisting of the finished panel. However, the wall finishing assembly having a gap control function presented in the above-cited prior art is a structure in which a vertical frame and a horizontal frame are attached to the wall of a building in a grid form, and a holding bracket and a finishing panel are attached to the frame, As a result, since the frame and the finishing panel are installed in the form of a grid in the cited prior art have a large load, thereby making them vulnerable to earthquakes. Besides, since all construction work is carried out at the work site, workability and constructability are poor.

In addition, the "vibration-resistant panel" required in the above-cited prior art uses a moving member inserted into the guide rail and a corner frame that supports the side frame to simultaneously absorb horizontal and vertical vibrations caused by an earthquake. As a result, as the fixed part is fastened to the outer wall of the building with bolts, the fixed part is easily separated from the outer wall of the building during vibration due to an earthquake. Thus, the durability and safety of assembly of the above-cited prior art deteriorate.

Thus, there is presently a need to improve the drawbacks, shortcomings, and limitations associated with the existing technologies, by providing an earthquake-resistant building interior/exterior material unit system having the earthquake-resistant capability.

BRIEF SUMMARY OF THE INVENTION

The present invention overcomes the drawbacks, shortcomings, and limitations associated with the above-cited prior arts by an earthquake-resistant building interior/exterior material unit system having the earthquake-resistant capability. The present invention achieves this by assembling exterior materials in advance in a factory to meet the specifications and standards of buildings and manufacturing them as units and manufacturing a plurality of exterior material units at the work site. Further, the exterior material units are attached to the walls of a building with an anchor bolt. The present invention has excellent workability and constructability, and as a number of building exterior materials are manufactured as a unit, productivity and economy are also excellent.

In the present invention, a pair of vertical frames are spaced apart from each other and are arranged symmetrically, such that the guide groove is formed in the longitudinal direction. Further, a plurality of exterior materials are attached to and installed on the outer side of the frame, and a plurality of clips are attached to and installed on the side portion of the one side frame. A bracket is then fixedly installed with a fastening bolt on a side portion of a frame on one side of the exterior material unit and an anchor bolt is fixedly installed on the wall of the building.

In addition, as an embodiment of the present invention, the frame is formed with a guide groove formed in the longitudinal direction on the side portion. The blade is formed to extend outwardly on the outer portion. The blade is formed with a cutting groove in the upper edge portion and the lower edge portion, respectively. Further, a plurality of cutting grooves are formed spaced apart at a predetermined interval.

In addition, as an embodiment of the present invention, a plurality of side holes are formed through the side of the frame at predetermined intervals on one side of the frame. In addition, as an embodiment of the present invention, the clip is constructed with a rod having a predetermined length on the outer side, and the rod is inserted into a side hole of a frame on one side to be assembled.

In addition, as an embodiment of the present invention, a long hole is formed on each surface bent at a right angle, and an outer surface that is in close contact with the side part of one side of the frame is formed in a round shape.

In addition, as an embodiment of the present invention, the bracket is formed with protrusions in the form of serrations on each inner surface bent at a right angle, and a washer having serrations formed to correspond to the protrusions is configured.

In addition, as an embodiment of the present invention, a protrusion is formed in a sawtooth shape on the side surface of the frame, and a protrusion is formed in a sawtooth shape on the outer surface of the bracket in close contact with the side surface of the frame. In an embodiment of the present invention, by assembling an exterior material to meet the specifications and standards of a building in a factory and manufacturing it as a unit, and attaching a plurality of exterior material units to the wall of the building with anchor bolts at the work site, the workability and constructability are improved.

Besides, the installation time is also reduced while reducing the workforce. Further, as a plurality of exterior materials is manufactured as a unit, productivity and economic efficiency are also excellent. In addition, in the embodiment of the present invention, since the exterior material unit is installed so that it can flow left and right, it has excellent seismic performance in response to external shocks or earthquakes, and the outer surface of the bracket is formed in a round shape. There is an effect that allows the exterior material unit to flow more flexibly in the bracket.

In addition, the existing prior art uses a heavy iron pipe to install an underlayment on the wall of a building, but the embodiment of the present invention uses an aluminum frame with excellent ductility, so the load is light and there is no fear of corrosion as well as a long lifespan. Besides, it is semi-permanent, and there is no risk of fire because welding is not required at the work site.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

FIG. 9 is a perspective view and a plan cross-sectional view showing the main part of the installation state of the clip in the present invention.

DETAILED DESCRIPTION OF THE PREFERRED EMBODIMENT

Figure 1:
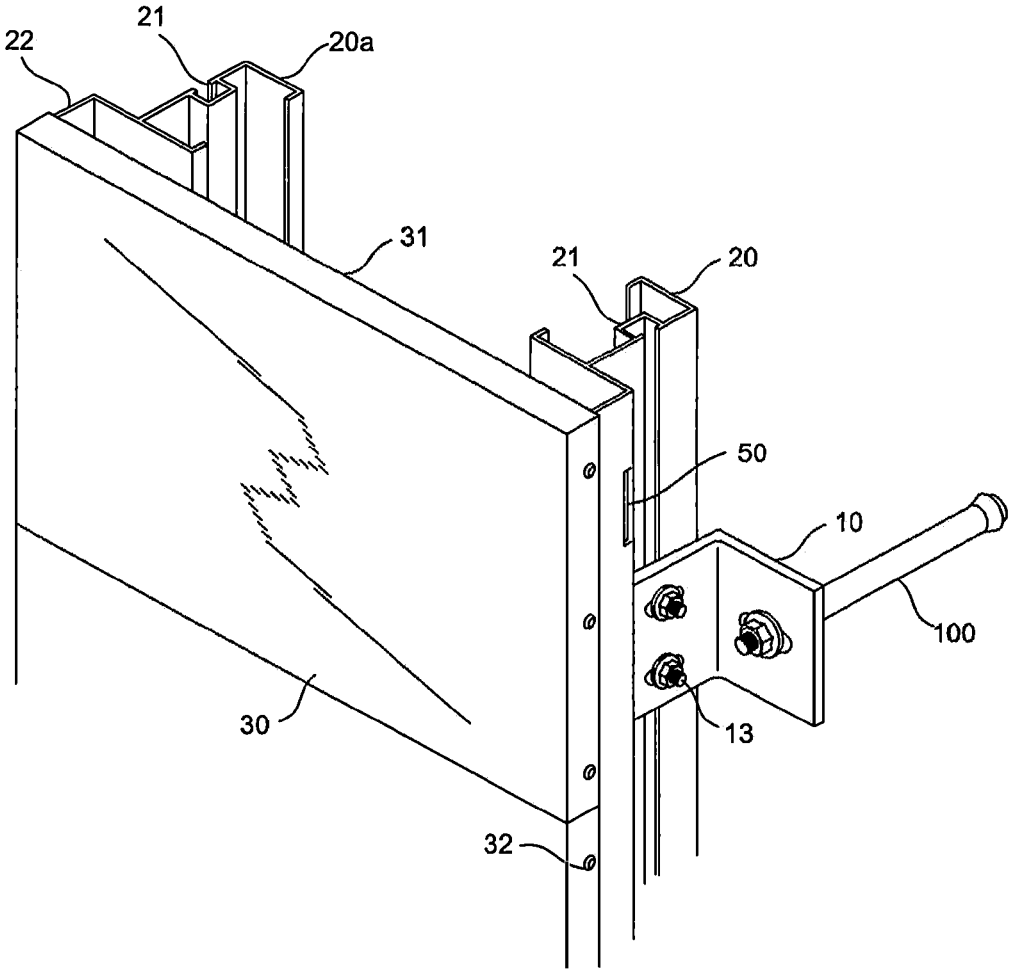
FIG. 1 is a partial perspective view showing an embodiment of the present invention.
Figure 2:
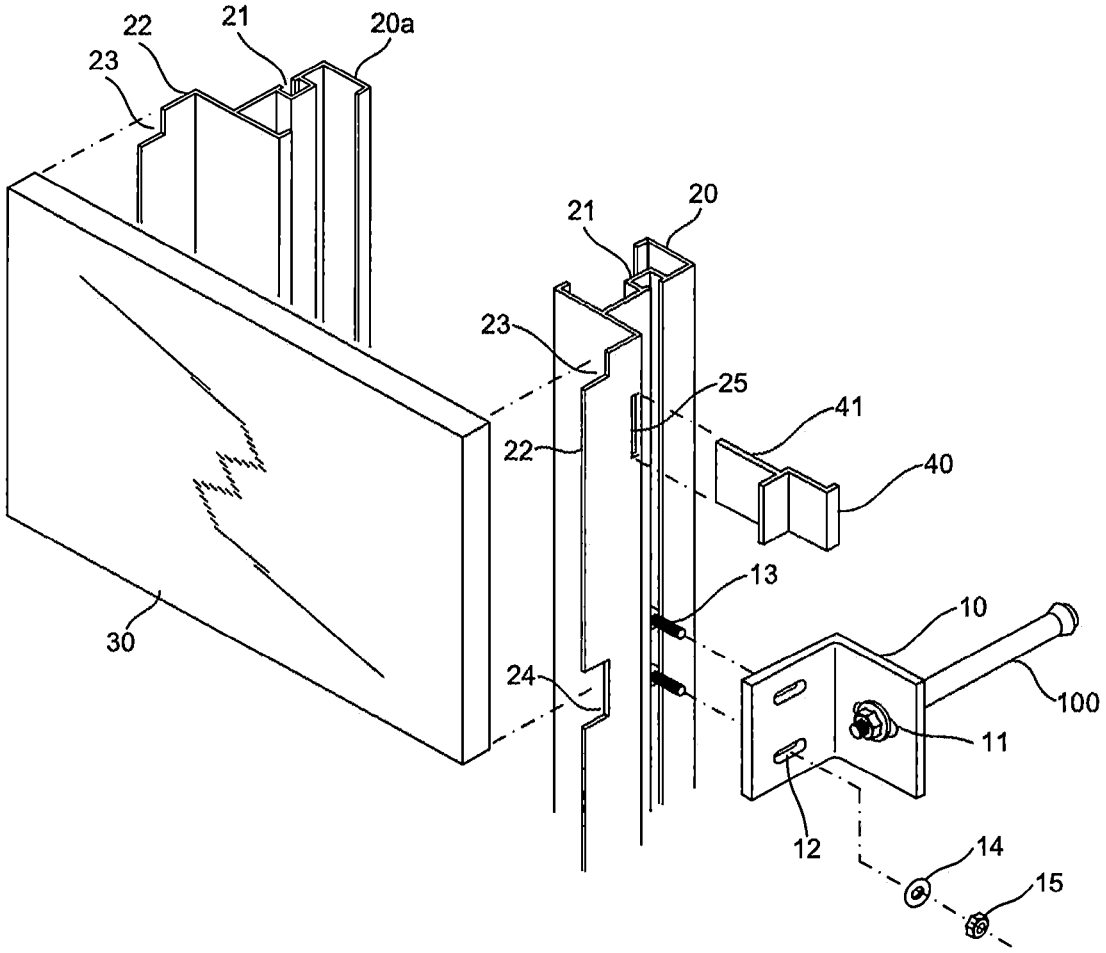
FIG. 2 is a partially exploded perspective view showing an embodiment of the present invention.
Figure 3:
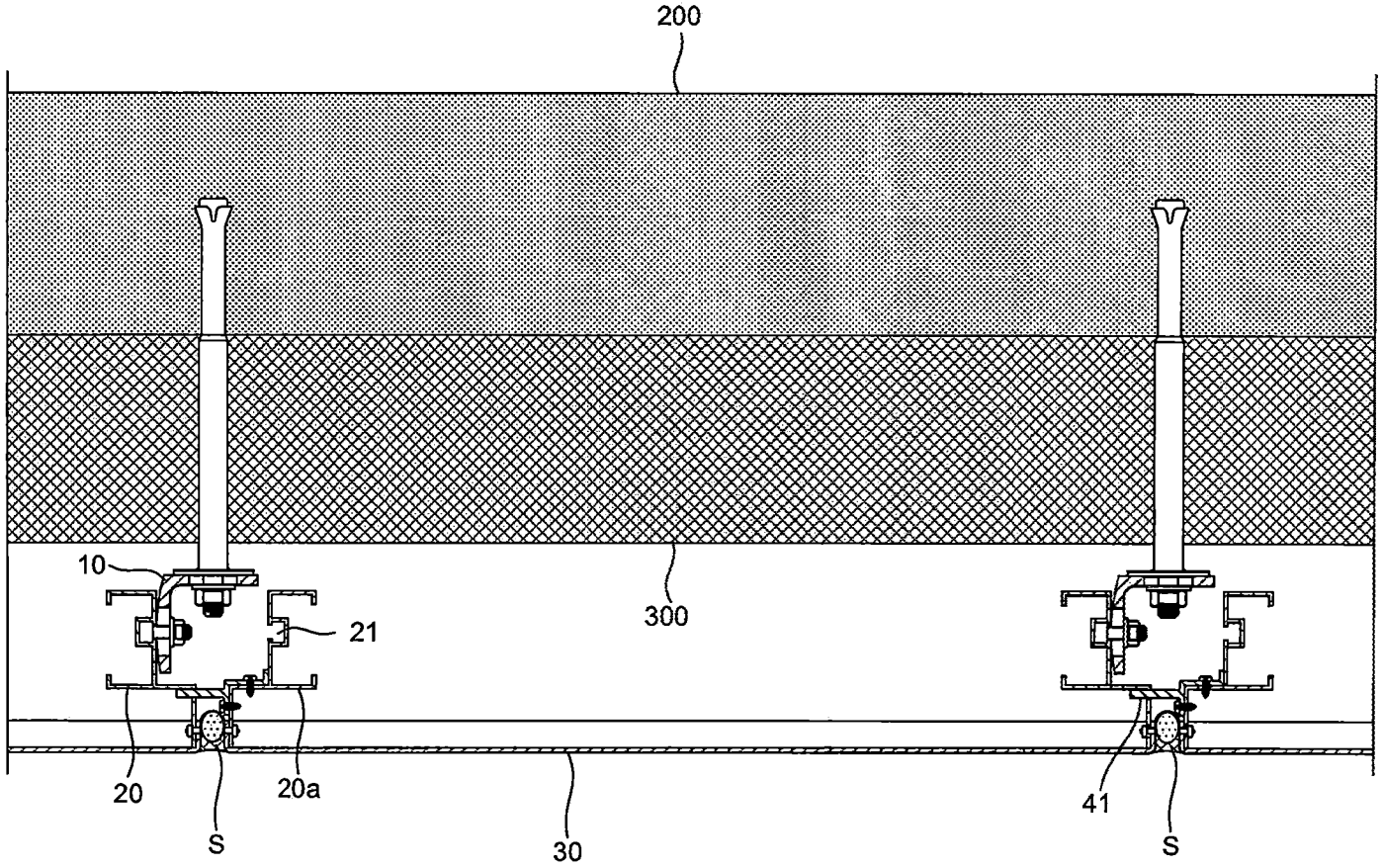
FIG. 3 is a plan sectional view showing the main part of the installation state in the present invention.
Figure 4:
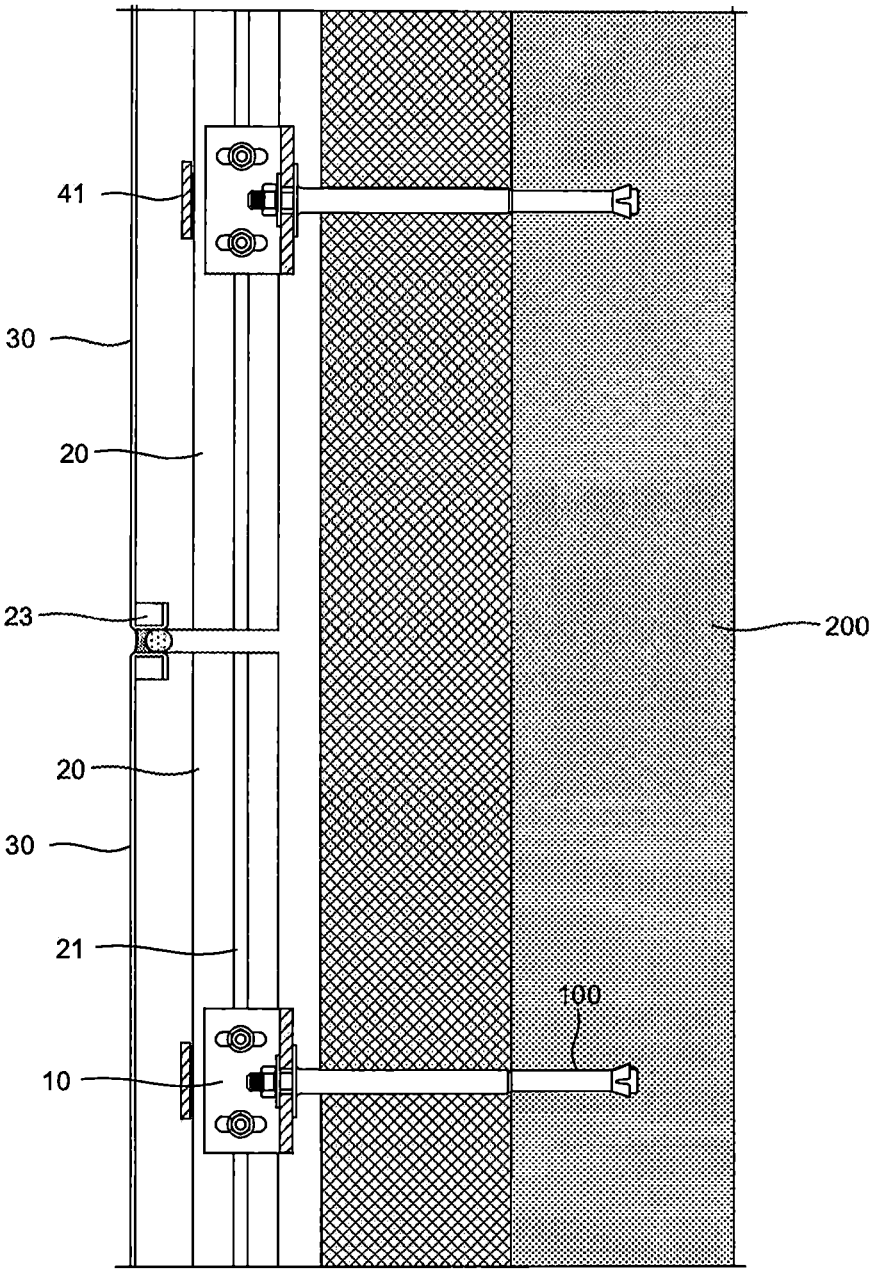
FIG. 4 is a main part side cross-sectional view showing the installation state in the present invention.
Figure 5:
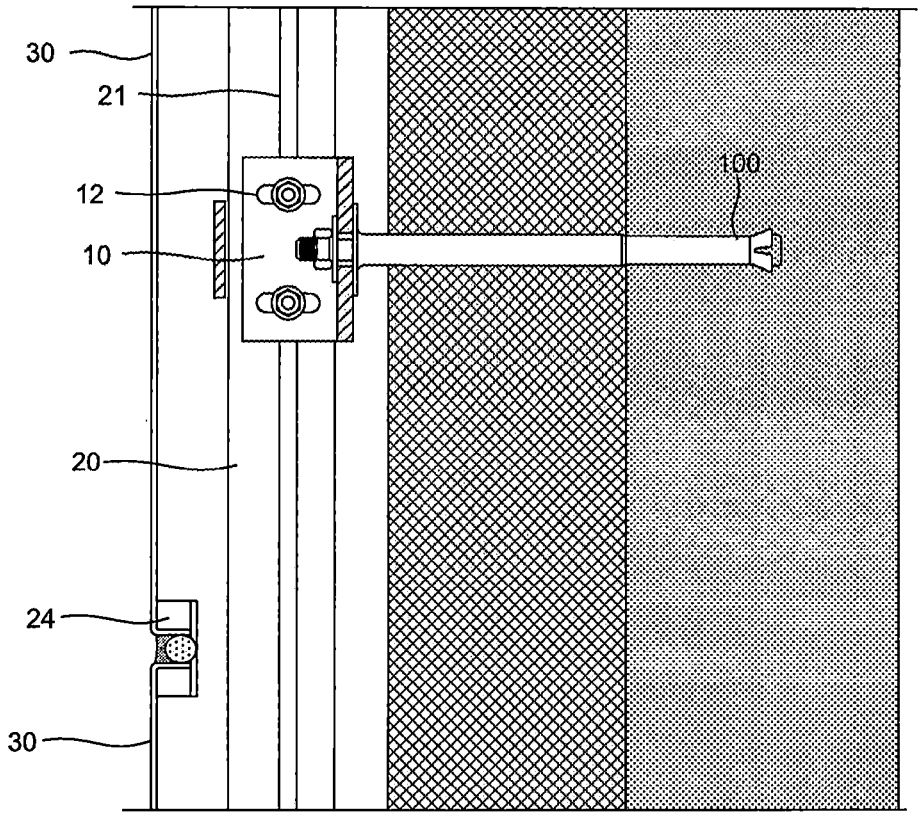
FIG. 5 is a side cross-sectional view of another main part showing an installation state in the present invention.
Figure 6:
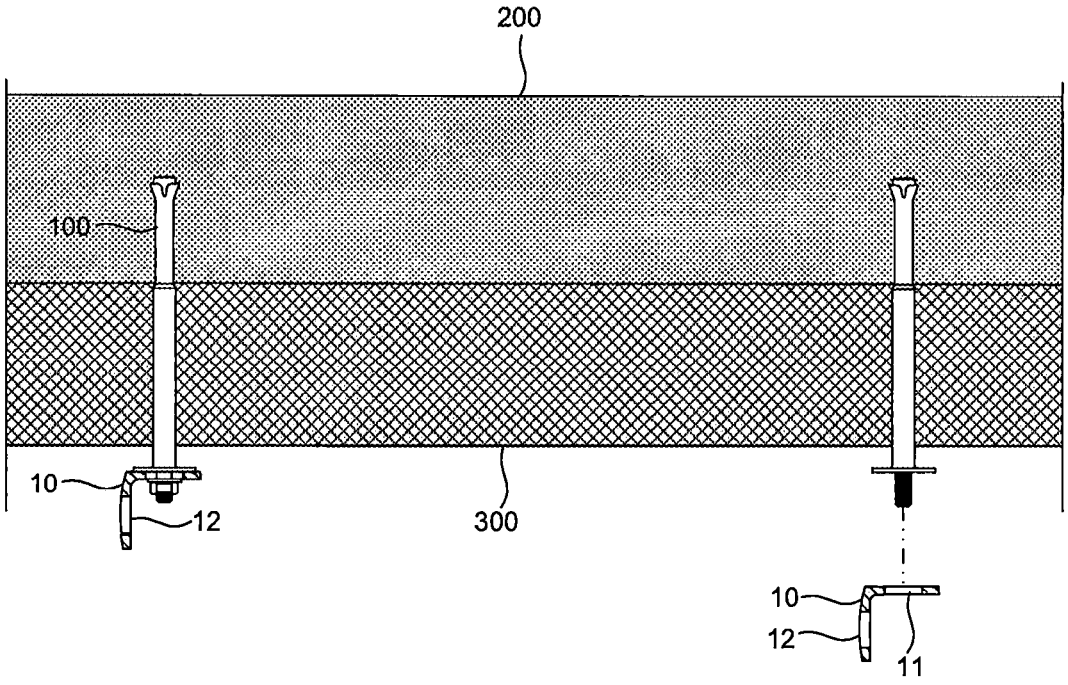
FIG. 6 is a plan sectional view showing the main part of the installation process in the present invention.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

Referring now to FIGS. 1 to 5, the preferred embodiment of the present invention comprises a pair of vertical frames 20 and 20*a* is spaced apart from each other and arranged symmetrically, in which a guide groove 21 is formed in the longitudinal direction. Further, a plurality of exterior materials 30 are attached to and installed on the outer side of frames 20 and 20*a*, and a plurality of clips 40 are attached to and installed on the side of the one of the frames 20*a*. Further, a bracket 10 is fixedly installed with a fastening bolt 13 on a side portion of one side of the frame 20 in the exterior material unit and an anchor bolt 100 in which the bracket 10 is fixedly installed on the wall 200 of the building.

In the preferred embodiment, the vertical frames 20 and 20*a* are functions of structures constituting the exterior material unit as shown in FIGS. 1 to 5. The vertical frames 20 and 20*a* are spaced apart from each other by a predetermined distance according to the size, and have a predetermined length according to the number of exterior materials 30 being employed.

In the above, the vertical frames 20 and 20*a* are preferably formed of lightweight aluminum material and may be molded using a single mold, manufactured by cutting to a predetermined length, spaced apart from each other, and disposed symmetrically to face each other in form of a pair.

Meanwhile, the vertical frames 20 and 20*a* have a rectangular shape with an open inner side with a guide groove 21 formed on the side surface in the longitudinal direction, and a blade 22 is formed on the outer side to extend outwardly.

In the above, blade 22 has cutting grooves 23 formed on the upper edge portion and the lower edge portion, respectively, and spaced apart at a predetermined interval according to the number of exterior materials 30 to form a plurality of cutting grooves 24, The plurality of cutting grooves 24 are formed to have a higher vertical height than the upper and lower cutting grooves 23.

In the above, the cutting grooves 23 and 24 formed in the blade 22 to insert the upper and lower edges 31 of the exterior material 30 when the plurality of exterior materials 30 are assembled to the blade 22.

In addition, in one side frame 20, a plurality of side holes 25 are formed through the side portion at predetermined intervals, and the side holes 25 are formed by attaching a plurality of exterior material units to wall 200 of the building during the construction process. The rod 41 of clip 40 to be described later is fitted and installed.

In addition, in the main configuration of the embodiment, the exterior material 30 functions to increase the aesthetics and durability of the building, and the exterior material 30 is preferably configured in a generally rectangular shape as shown in FIGS. 1 to 5. The external material is manufactured in a predetermined size according to the standards and specifications.

In the above, the exterior material 30 is formed by bending the periphery inward, and the edges 31 are formed on the inner portions of the top and bottom, respectively, and on both sides of the blades 22 in a pair of vertical frames 20 and 20*a*. After being fitted, the exterior material 30 is attached and installed with a plurality of rivets (32).

The exterior material 30 is inserted so that the upper and lower edges 31 are inserted into the cutting grooves 23 and 24 formed in the blade 22, and both sides of the exterior material 30 surround the blade 22. After being fitted and assembled, a plurality of rivets 32 are fastened to both sides of the exterior material 30 and the blade 22 to attach and install the exterior material 30.

In the above, the exterior material 30 may be configured in plurality in a pair of vertical frames 20 and 20*a* according to the specifications and standards of the building, and a plurality of exterior materials 30 are disposed of adjacent to each other, and the exterior material 30. Further, an O-ring and a sealant (S) are embedded between them to increase the air tightness.

In addition, in the main configuration of the embodiment, the clip 40 is inserted into the side hole 25 on one of the sides of the frame 20 during the construction process of the exterior material unit and assembled, as shown in FIGS. 2 to 5. Similarly, a screw piece is attached to the side of the edge of blade 22 in one frame 20*a*, and rod 41 is formed in an outward direction.

In the above, the clip 40 is preferably formed of lightweight aluminum material, and as shown in FIG. 9, and rod 41 of a predetermined length is configured on the outer side of clip 40. The rod 41 is inserted into the side hole 25 of the frame 20 on one side in the exterior material unit that has already been attached and constructed to be assembled.

Figure 10:
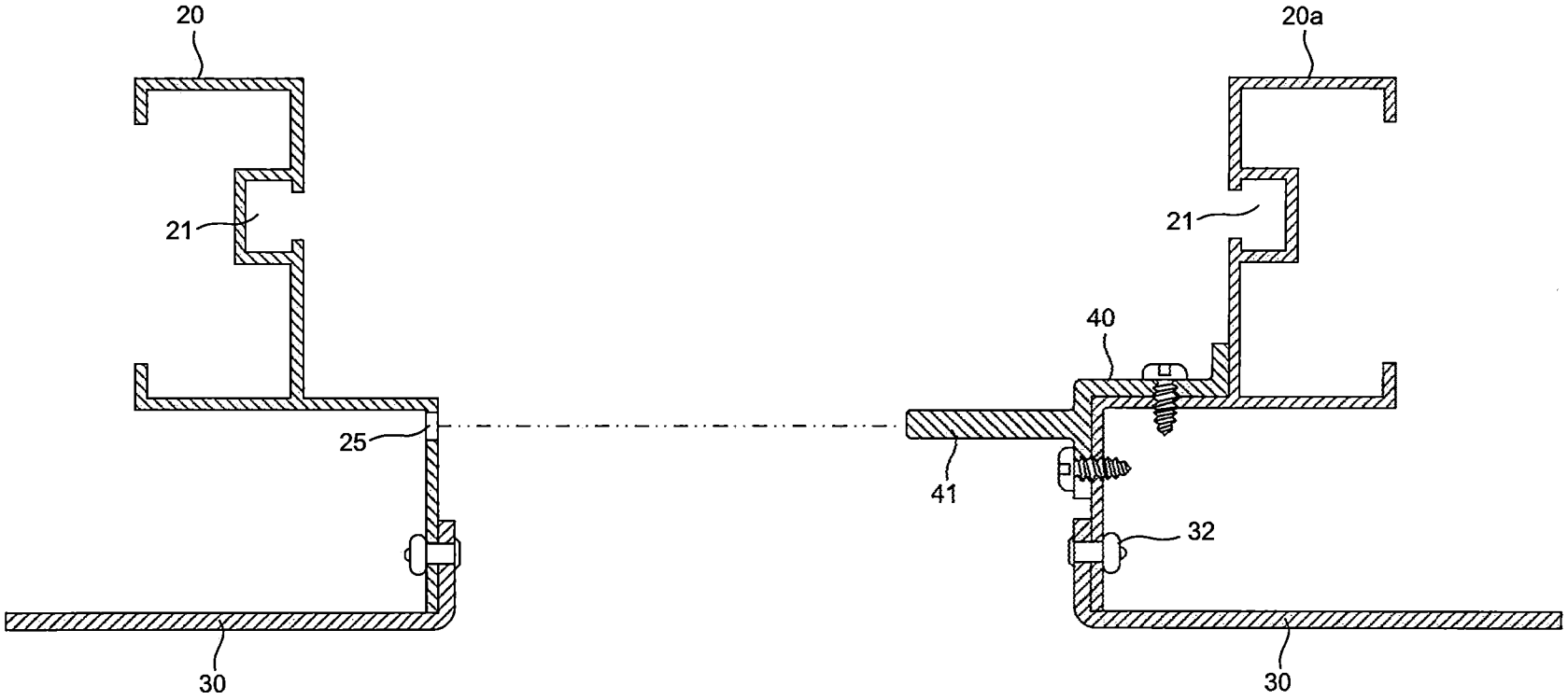
FIG. 10 is a plan cross-sectional view showing the construction state of the clip in the present invention.

On the other hand, since rod 41 of clip 40 is assembled by being inserted into the side hole 25 of frame 20 as shown in FIG. 10, rod 41 moves left and right in the side hole 25 As a result, the exterior material unit is constructed so that it can flow left and right on the wall 200 of the building.

Figure 7:
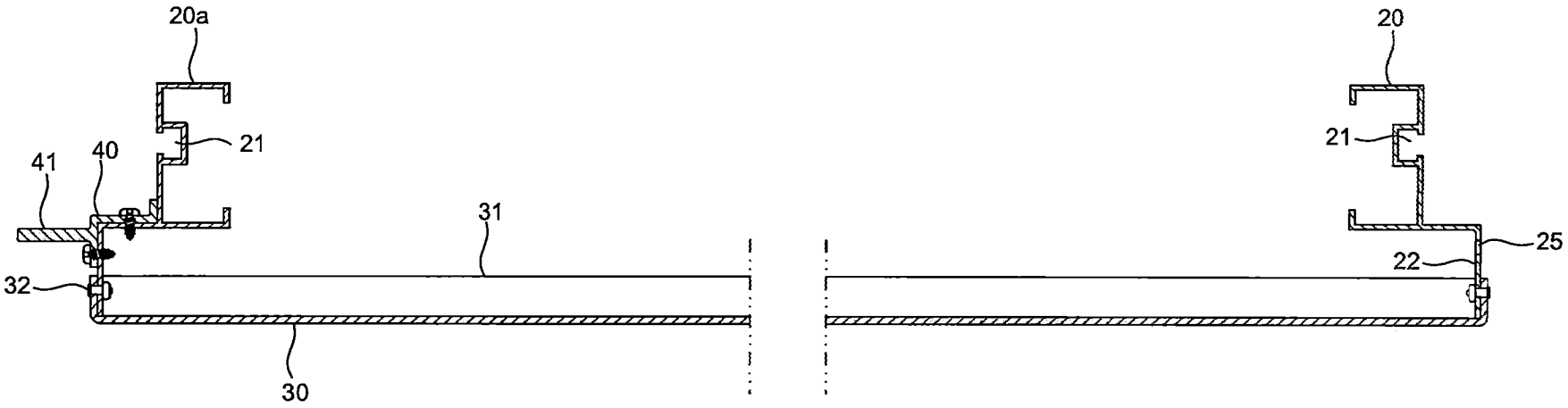
FIG. 7 is a plan cross-sectional view showing the exterior material unit in the present invention.
Figure 11:
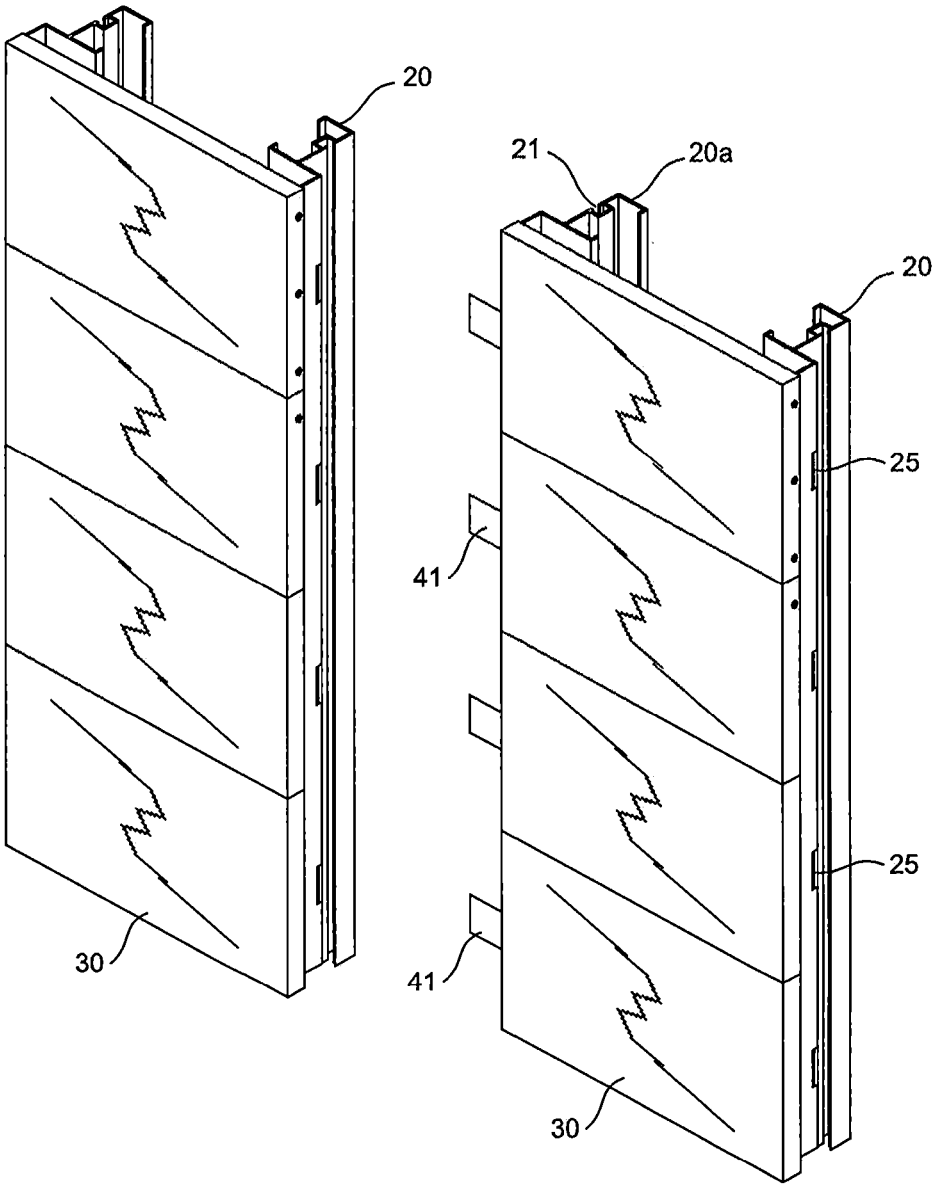
FIG. 11 is a perspective view showing the exterior material unit in the present invention.

Accordingly, in the case of the exterior material unit, as shown in FIGS. 7 and 11, the pair of vertical frames 20 and 20*a* are symmetrically spaced apart from each other to meet the specifications and specifications of the building, and the vertical frames 20, 20*a* are configured by attaching a plurality of exterior materials 30 to the outer portion while a plurality of clips 40 is attached to the side portion of one side frame 20*a*. The exterior material unit having such a configuration can be pre-fabricated in a factory to meet the specifications and standards of the building, thereby reducing fieldwork as much as possible, thereby improving workability as well as improving productivity and economy.

In addition, in the main configuration of the above embodiment, bracket 10 is used for attaching and constructing the exterior material unit to wall 200 of the building, and the bracket 10 is fixedly installed on the side part of the frame and is preferably molded from lightweight aluminum material.

In the above, bracket 10 is configured to be bent in an inverted L-shape, and long holes 11 and 12 are formed on each surface bent at a right angle, and guide grooves 21 of one side frame 20 in the exterior material unit. The head portion of the fastening bolt 13 is fitted to the arrangement, and the long hole 12 of the side part is fitted to the fastening bolt 13, and then the washer 14 and the nut 15 are coupled to the fastening bolt 13, thereby causing the bracket 10 to be fixedly installed on the side of the frame 20.

In the above, the fastening bolt 13 is arranged so that the head part of the bolt 13 is inserted in the downward direction from the open upper side of the guide groove 21 so that the head part of the bolt 13 does not separate from the guide groove 21, and also has one long hole 11 formed in the bracket 10, which is inserted into the anchor bolt 100 and installed.

Figure 8:
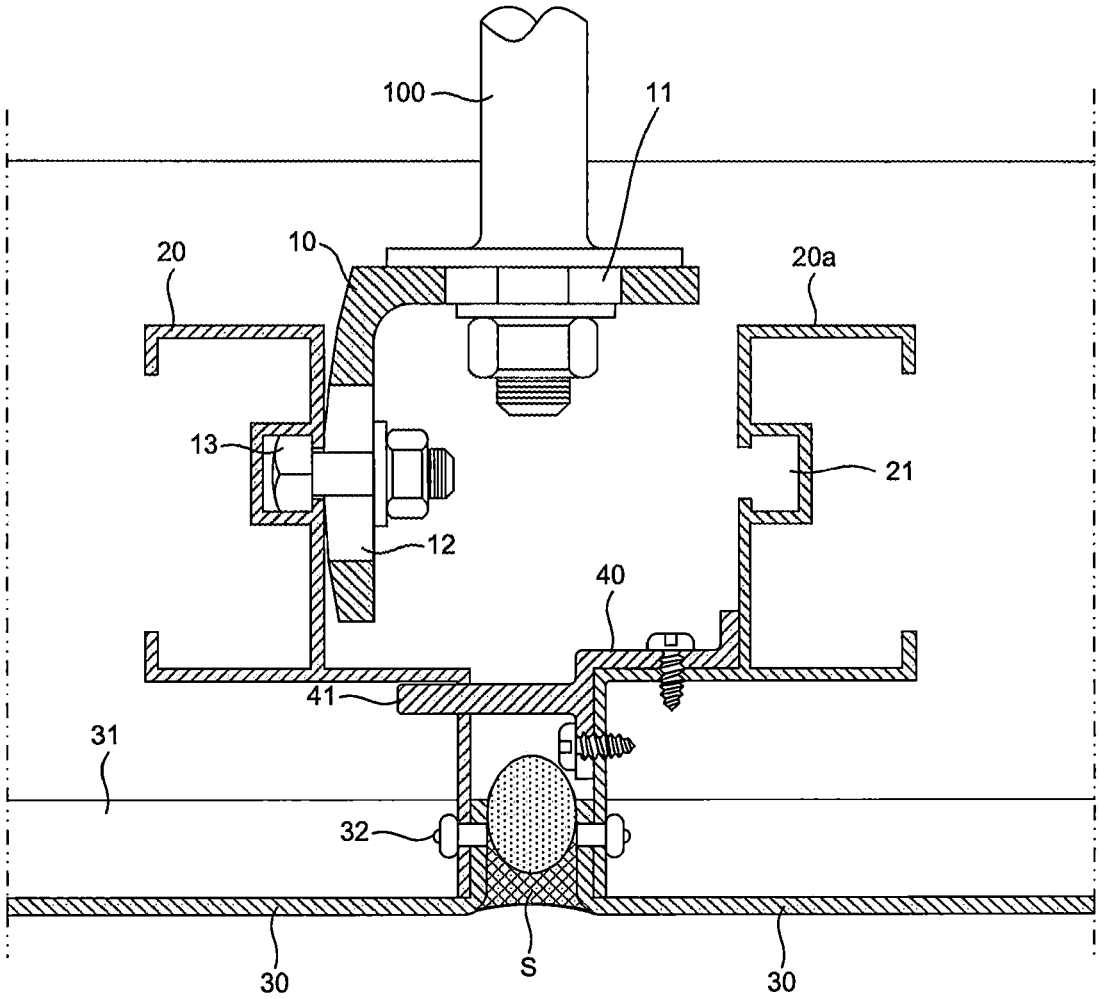
FIG. 8 is a plan sectional view showing the main part of the installation state in the present invention.

On the other hand, as shown in FIG. 8, by forming the outer surface of bracket 10 in close contact with the side part of frame 20 in a round shape, when an external shock or earthquake occurs, the exterior material unit is more flexible in the bracket 10 It is implemented to be flexible.

In addition, in the main configuration of the embodiment, the anchor bolt 100 fixes the exterior material unit to wall 200 of the building as shown in FIGS. 1 to 6. It is fixedly installed by punching a hole in the insulating material 300 and the wall 200 installed outside the building.

In the above, by inserting the long hole 11 of bracket 10 into the screw portion of the anchor bolt 100, and then fastening the washer and the nut to the screw portion, the bracket 10 is fixed to the anchor bolt 100, thereby installing and attaching the exterior material unit to the wall 200 of the building through the bracket 10.

The embodiment of the present invention having such a configuration is first manufactured by assembling a plurality of exterior material units to meet the specifications and standards of a building in a factory, and a plurality of anchor bolts 100 are appropriately applied to the wall 200 of the building at the work site. It is installed by driving in the position, and then the brackets 10 are respectively attached to the anchor bolts 100, and the exterior material unit is attached to the brackets 10

At this time, as for the exterior material unit, one side frame 20 is attached to the anchor bolt 100 through the bracket 10 and the other side frame 20*a* is an adjacent exterior material with the rod 41 of the clip 40 already attached and constructed. The external material unit is inserted into the side hole 25 of the frame 20 and assembled.

As a result, in the case of the exterior material unit, only one frame 20 is attached to the anchor bolt 100 through the bracket 10 and the other frame 20*a* is the frame 20 to which the rod 41 of the clip 40 is adjacent. Since the rod 41 is fitted inside hole 25 of the side frame and installed, it can flow in left and right direction, thereby providing seismic resistance in response to external shocks or earthquakes.

Figure 12:
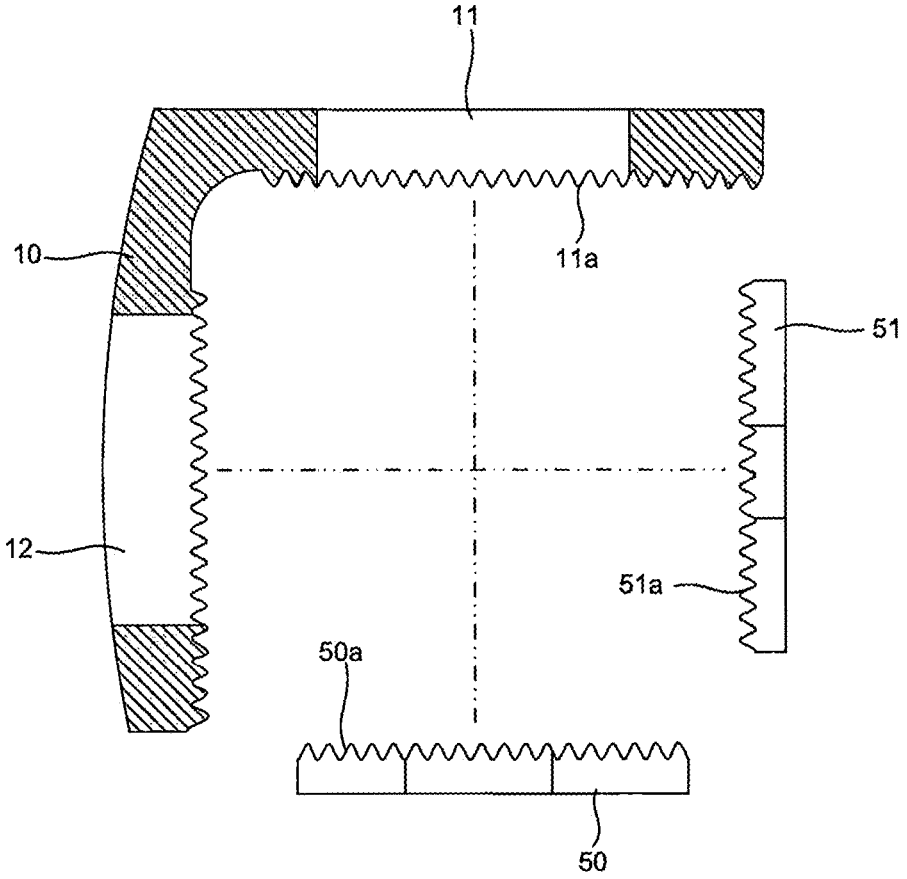
FIG. 12 is a plan cross-sectional view showing an embodiment of the bracket in the present invention.
Figure 13:
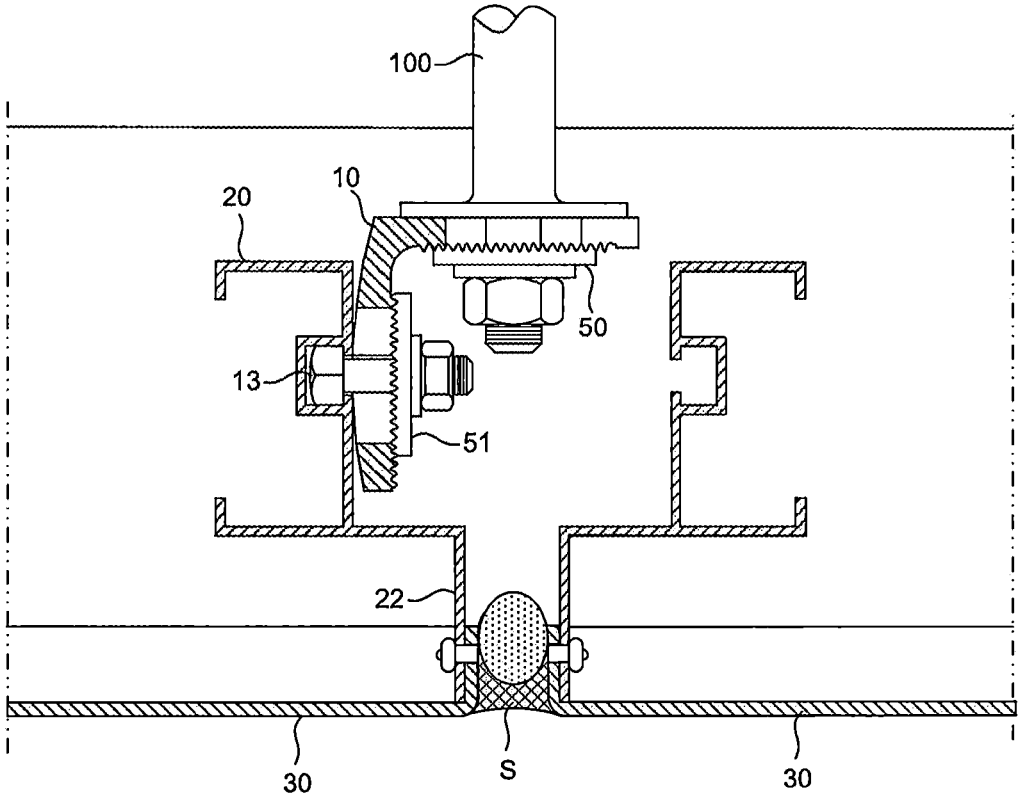
FIG. 13 is a plan cross-sectional view showing the installation state of the bracket in the present invention.

Meanwhile, in the embodiment of the present invention, as shown in FIGS. 12 and 13, protrusions 11*a* and 12*a* are formed in a sawtooth shape on each inner surface bent at a right angle in the bracket 10. Further, toothed projections 50*a* and 51*a* are formed in the washer 50 and 51 that correspond to the protrusions of the bracket 10.

In the above embodiment, by installing the washers 50 and 51 formed with the toothed projections 50*a* and 51*a* into the threaded portion of the anchor bolt 100 and the fastening bolt 13, the toothed projections 50*a* and 51*a* of the washers 50 and 51 meshes with protrusion 12*a* of the bracket, which increases the adhesion and fixing force of the washers 50 and 51, so that the durability is further strengthened while being flexible to external shocks or earthquakes.

Figure 14:
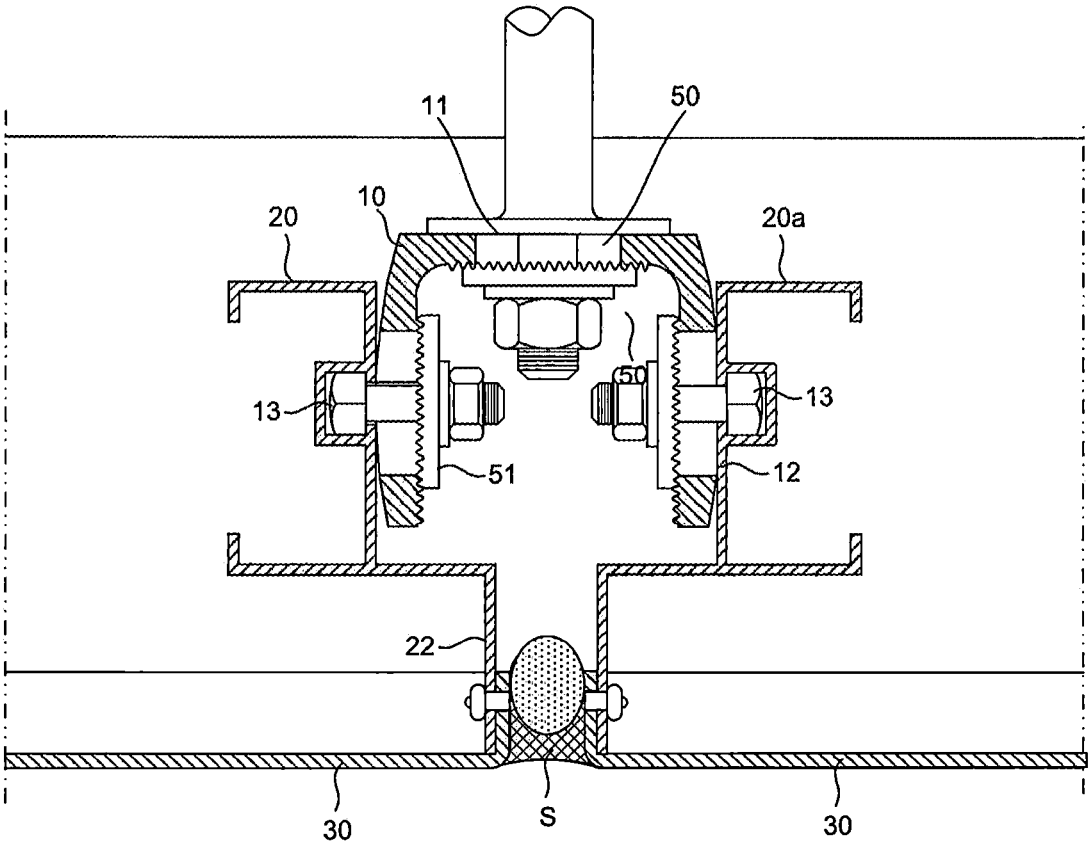
FIG. 14 is a plan cross-sectional view showing another embodiment of the bracket in the present invention.
Figure 15:
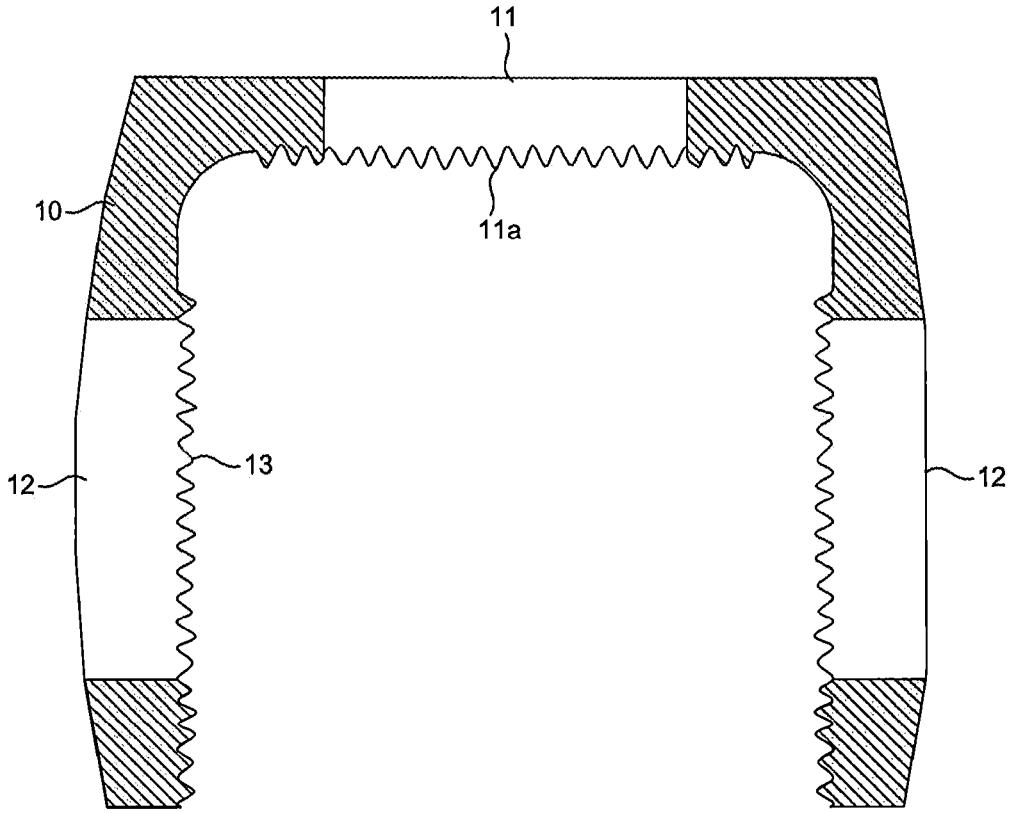
FIG. 15 is a plan sectional view showing another installation state of the bracket in the present invention.

In addition, in an embodiment of this invention, as shown in FIGS. 14 and 15, the bracket 10 is bent in the ∏ shape. The protrusions 11*a* and 12*a* are formed in the inner surface of each of the bracket 10 in a sawtooth shape, and the sawtooth protrusions 50*a* and 51*a* correspond to the protrusions 11*a* and 12*a* formed on the washers 50 and 51.

In the embodiment, the toothed projections 50*a* and 51*a* of the washers 50 and 51 engage with the inner surface projections 11*a* and 12*a* of bracket 10, so that the adhesion and fixing force of the washers 50 and 51 are increased. In particular, one side frame 20 of the exterior material unit is attached to the anchor bolt 100 through the bracket 10, while the other frame 20*a* of the exterior material unit adjacent thereto is attached to the anchor bolt (10) through the bracket (10). 100) can be attached and installed.

Figure 16:
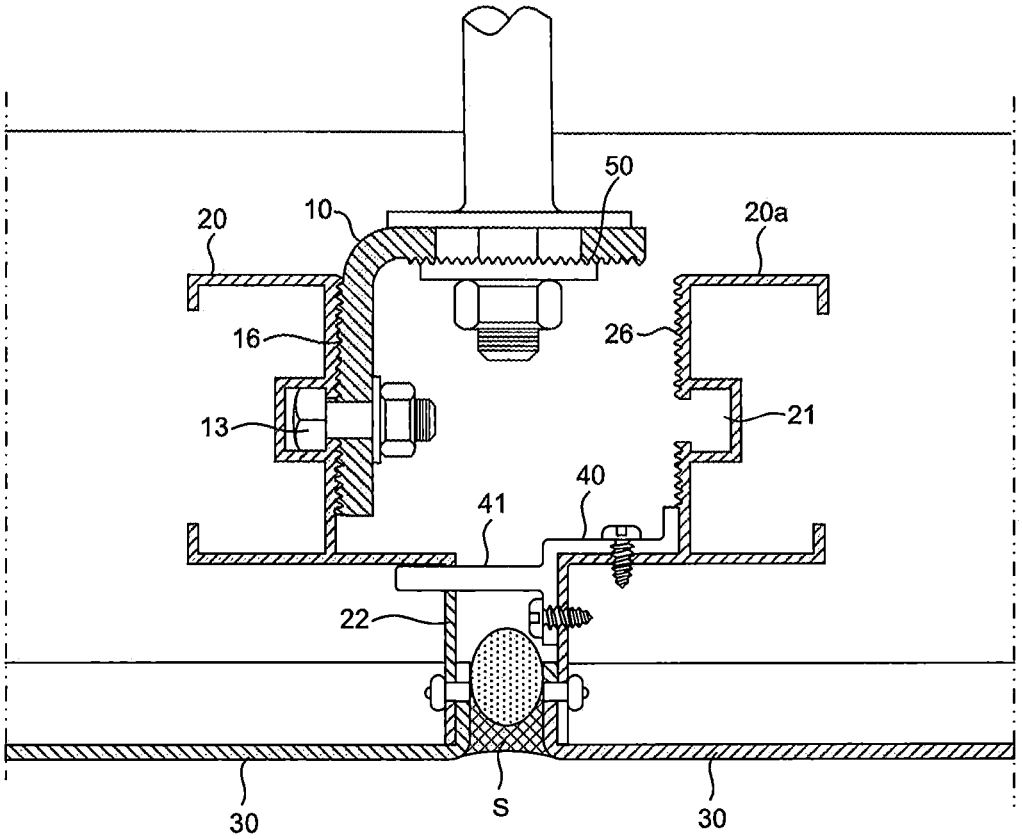
FIG. 16 is a cross-sectional plan view of an installation state showing another embodiment of the bracket in the present invention.
Figure 17:
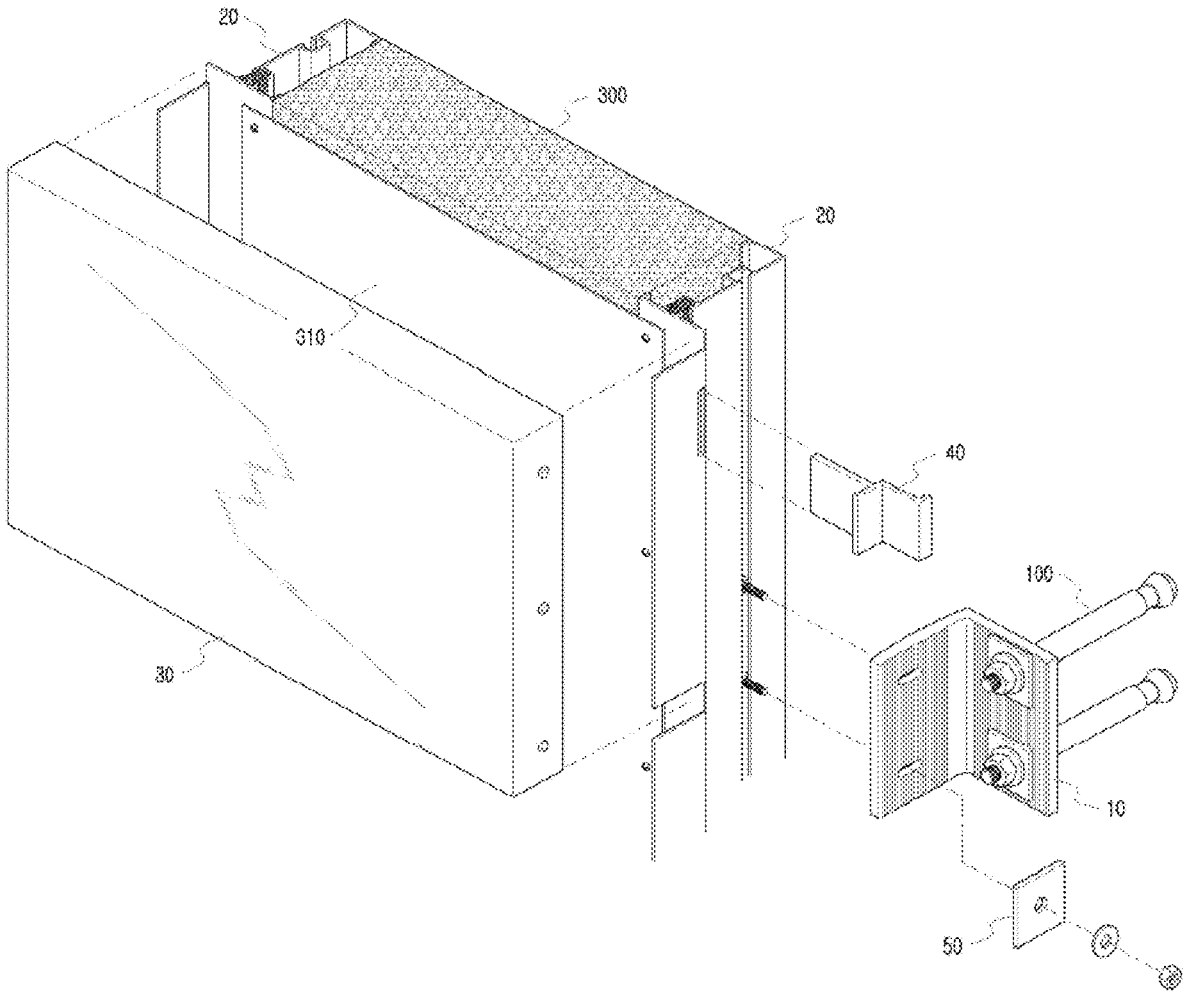
FIG. 17 is an exploded perspective view of a thermal insulation system, showing an embodiment of the present invention.
Figure 18:
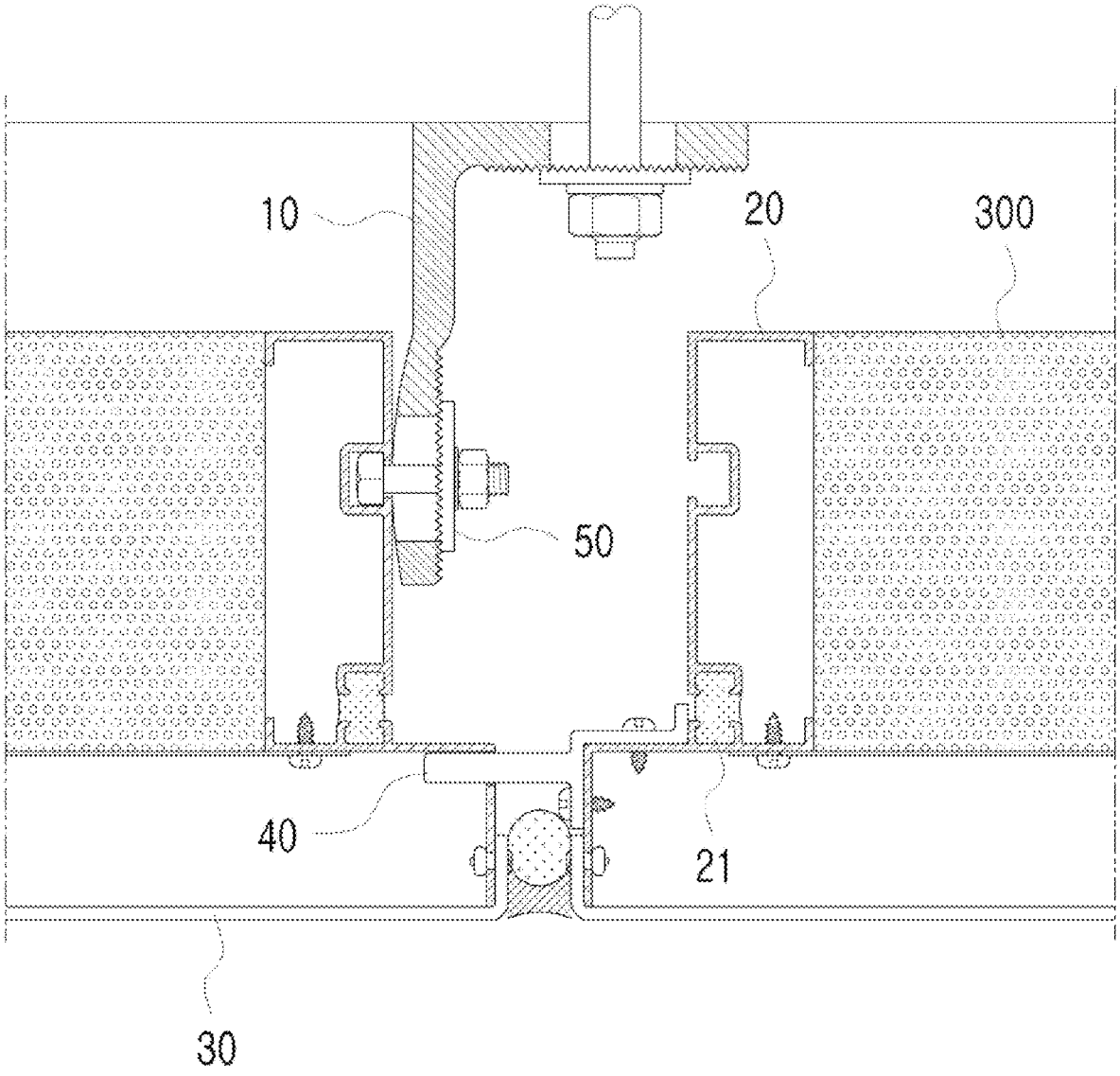
FIG. 18 is a plane sectional view of a thermal insulation system, showing an embodiment of the present invention.
Figure 19:
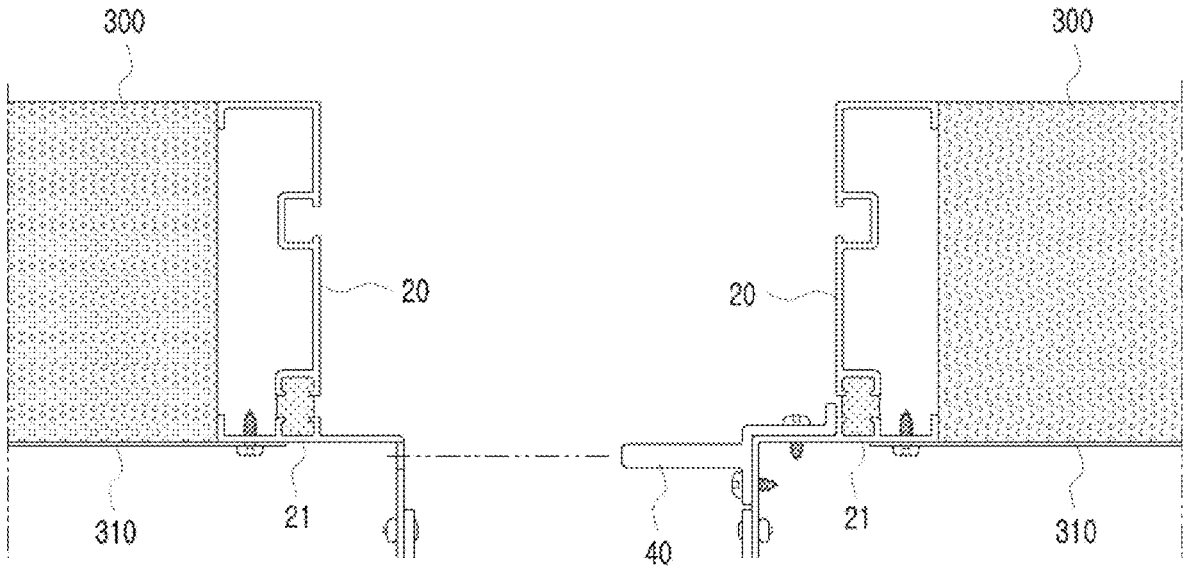
FIG. 19 is a plane cross-sectional view of a thermal insulation system, indicating the construction of the clip in the present invention.
Figure 20:
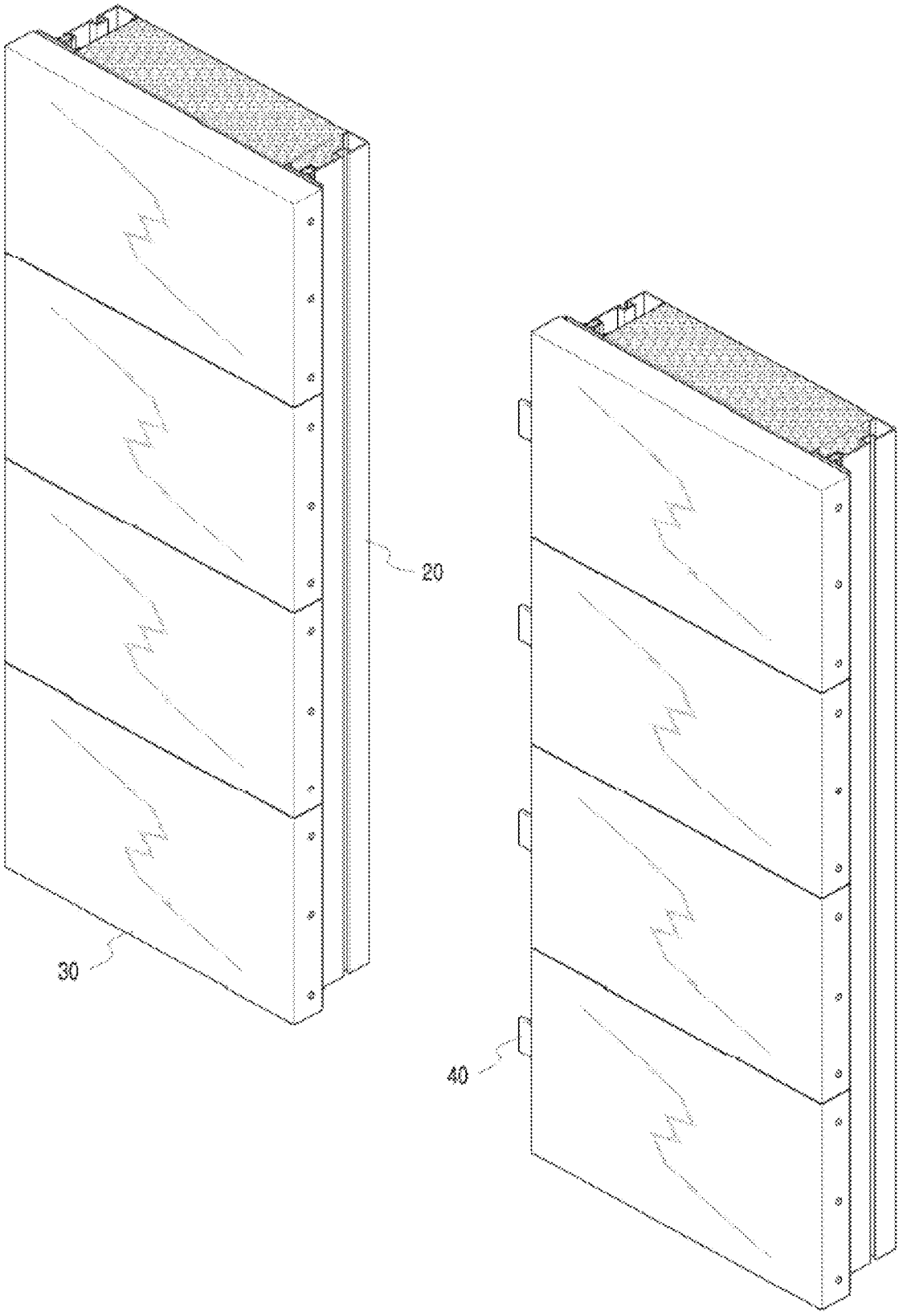
FIG. 20 is a perspective view of a thennal Insulation and earthquake-resistant building interior and exterior system, showing an embodiment of the present invention.

In addition, in the embodiment of the present invention, as shown in FIG. 16, in the exterior material unit, the protrusions 26 are formed in the form of sawtooth on the side portions of both sides of the frames 20 and 20*a*, and the brackets are in close contact with the side portions of the frame 20. A protrusion 16 may be formed in a sawtooth shape on the outer surface of (10). In the above embodiment, since the outer surface projection 16 of bracket 10 is engaged with the side protrusion 26 of frame 20, the adhesion and fixing force between frame 20 and bracket 10 are increased, thereby increasing the durability and flexibility of the unit to external shocks and earthquakes.

In addition, in the embodiment of the present invention, as shown in FIG. 17 to FIG. 20, an adiabatic hard polyurethane joint 21 azon is installed in the vertical frame 20 to block cold and heat, thereby increasing the insulation effect. A phenol formaldehyde (PF) foam insulation 300 is installed between the vertical frames 20 to maximize the insulation effect by fixing the same to the vertical frame 20 with an electro-galvanized iron (EGI) 1.OT steel plate 310 (steel back panel).

In addition, in the embodiment of this invention, vertical frame 20, insulation 300, EGI 1.OT steel plate 310, and exterior 30 are assembled, in factory, as an insulation and earthquake-resistant system, and completed with bolt assembly, only, in the field.

Therefore, in the embodiment of the present invention, the exterior material is assembled in advance in a factory to meet the specifications and standards of the building and manufactured as a unit, and a plurality of exterior material units are attached to the wall of the building with anchor bolts at the work site and constructed, thereby performing fieldwork. Since it is reduced as much as possible, it is not only excellent in workability and constructability, but also increases productivity and economic feasibility by manufacturing a number of building exterior materials as a unit, shortens working time and reduces working manpower.

The preferred embodiment of the present invention has been described with reference to the above, and it is not limited to the above embodiment, and a person of ordinary skill in the art to which the present invention belongs through the above embodiment does not deviate from the gist of the present invention It can be implemented with various changes in.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a nonexclusive manner, indicating that the referenced elements, components, or steps may be present, or utilized, or combined with other elements, components, or steps that are not expressly referenced.

Particular features of the invention are emphasized in the claims which follow.

What is claimed is:

1. An earthquake-resistant interior and exterior material unit system for a building, the system comprising:

a pair of vertical frames including a first frame and a second frame that are spaced apart from each other and arranged symmetrically and respectively have a guide groove formed in a longitudinal direction;

a plurality of exterior materials attached to and installed on an outer side of the pair of vertical frames, wherein an exterior material attached to the first frame is different from an exterior material attached to the second frame;

a plurality of clips coupling the first frame with the second frame to be paired;

a bracket fixedly installed with a fastening bolt on a first portion of the first frame; and an anchor bolt fixing the bracket to a wall of the building, wherein one of the first frame and the second frame has a plurality of side holes formed at a predetermined interval, each of the clips has a rod of a predetermined length extending from a clip body, and the rod is inserted into one of the side holes and the clip body is fixed to the other of the first frame and the second frame to couple the first frame with the second frame.

2. A system in accordance with claim 1, where the pair of vertical frames have a blade formed to extend outwardly on the outer side of the pair of vertical frames and cutting grooves formed at an upper edge portion and a lower edge portion of the blade, respectively, and spaced apart at a predetermined interval.

3. A system in accordance with claim 1, wherein the first frame has the plurality of side holes and the clip body is fixed to the second frame.

4. A system in accordance with claim 1, wherein the bracket comprises two plates that are bent at a right angle and respectively have a long hole.

5. A system in accordance with claim 1, wherein the bracket comprises two plates that are bent at a right angle and respectively have protrusions having a sawtooth shape on each inner surface of the plates, and wherein washers respectively having sawtooth protrusions corresponding to the protrusions of the bracket are provided on the each inner surface of the plates.

6. A system in accordance with claim 1, wherein the pair of vertical frames have serrated protrusions formed on the first portion of the first frame, wherein the bracket has serrated protrusions on an outer surface of the bracket, and wherein the serrated protrusions of the bracket are in close contact with the serrated protrusions of the first frame.

7. A system in accordance with claim 1, wherein the pair of vertical frames are equipped with an adiabatic hard polyurethane joint to block cold and heat, wherein a foam insulation is installed between adjacent two pairs of vertical frames, and wherein a steel back panel is installed on an outer side of the foam insulation.

* * * * *